US011008125B2

(12) United States Patent
Kruzel

(10) Patent No.: US 11,008,125 B2
(45) Date of Patent: May 18, 2021

(54) TOOL FOR TENSIONING METAL LOCKING TIES

(71) Applicant: Panduit Corp., Tinley Park, IL (US)

(72) Inventor: Mateusz Kruzel, Orland Park, IL (US)

(73) Assignee: Panduit Corp., Tinley Park, IL (US)

( * ) Notice: Subject to any disclaimer, the term of this patent is extended or adjusted under 35 U.S.C. 154(b) by 196 days.

(21) Appl. No.: 16/408,585

(22) Filed: May 10, 2019

(65) Prior Publication Data

US 2019/0352030 A1 Nov. 21, 2019

Related U.S. Application Data

(60) Provisional application No. 62/673,231, filed on May 18, 2018.

(51) Int. Cl.
*B65B 13/24* (2006.01)
*B65B 13/02* (2006.01)

(52) U.S. Cl.
CPC ..... *B65B 13/027* (2013.01)

(58) Field of Classification Search
CPC ..... B65B 13/025; B65B 13/027; B65B 13/24; B65B 13/22
See application file for complete search history.

(56) References Cited

U.S. PATENT DOCUMENTS 2,871,738 A * 2/1959 Abbiati ..... B25B 25/005 81/9.3
3,782,426 A * 1/1974 Morgan ..... B65B 13/027 140/123.6
4,410,019 A * 10/1983 Suzuki ..... B65B 13/027 140/123.6
4,449,429 A 5/1984 Sauer et al.
6,481,467 B2 11/2002 Czebatul et al.
7,591,451 B2 9/2009 Dyer et al.
8,356,641 B2 1/2013 Marelin et al.
8,793,841 B2 8/2014 DeBerry et al.
9,132,928 B2 9/2015 Rooth
2009/0121069 A1* 5/2009 Dyer ..... B65B 13/025 242/410
2012/0060703 A1 3/2012 Stiefvater et al.
2012/0061061 A1 3/2012 Stiefvater et al.
2016/0167813 A1* 6/2016 Myers ..... B65B 13/027 254/250

FOREIGN PATENT DOCUMENTS

CH 561383 A5 4/1975
GB 400139 10/1933
WO 2017183073 A1 10/2017

* cited by examiner

*Primary Examiner* — Adam J Eiseman
*Assistant Examiner* — Bobby Yeonjin Kim
(74) *Attorney, Agent, or Firm* — Christopher S. Clancy; James H. Williams; Aimee E. McVady

(57) ABSTRACT

A power tool that tensions metal locking ties. The power tool includes a base with a drive mechanism and a tool head mounted to the base. The tool head includes a tension mechanism, a gripper assembly secured to the tension mechanism, and a tool nose. The tension mechanism includes a lead screw secured to an electric driver in the base and a lead nut attached to the lead screw. The gripper assembly includes a gripper housing secured to the lead nut. As the lead screw rotates, the lead nut moves along the lead screw pulling the gripper housing toward the base of the tool to tension the metal locking tie.

12 Claims, 13 Drawing Sheets

TOOL FOR TENSIONING METAL LOCKING TIES

CROSS REFERENCE TO RELATED APPLICATIONS

This application claims priority to U.S. Provisional Application No. 62/673,231, filed May 18, 2018, the subject matter of which is hereby incorporated by reference in its entirety.

FIELD OF THE INVENTION

The present invention relates to a tool for tensioning metal locking ties, and more particularly to a power tool for tensioning metal locking ties.

BACKGROUND OF THE INVENTION

As is well known to those skilled in the art, cable ties or straps are used to bundle or secure a group of articles such as electric wires and cables. Cable ties of conventional construction include a cable tie head and an elongated tail extending therefrom. The tail is wrapped around a bundle of articles and thereafter inserted through the passage in the head. The head of the cable tie typically supports a locking element, which extends into the head passage and engages the body of the tail to secure the tail to the head.

In practice, the installer manually places the ties about the articles to be bundled and inserts the tail through the head passage. At this point, a cable tie installation tool is used to tension the tie to a predetermined tension. The tools of the prior art, although capable of tensioning and thereafter severing the excess portion of the cable tie, typically have several disadvantages therewith.

As a result, it is desirable to provide an improved metal tie tool for tensioning metal locking ties that is easy to operate, operates quickly, and reduces operator fatigue.

SUMMARY OF THE INVENTION

The present invention is directed to a power tool for tensioning metal locking ties. The power tool has a base and a tool head mounted to the base. The base includes a drive mechanism. The tool head includes a tension mechanism, a gripper assembly secured to the tension mechanism, and a tool nose. The tension mechanism includes a lead screw and a lead nut attached to the lead screw. The gripper assembly includes a gripper housing secured to the lead nut. When the lead screw rotates, the lead nut moves along the lead screw pulling the gripper housing towards the base of the tool to tension the metal locking tie.

DETAILED DESCRIPTION

Figure 1:
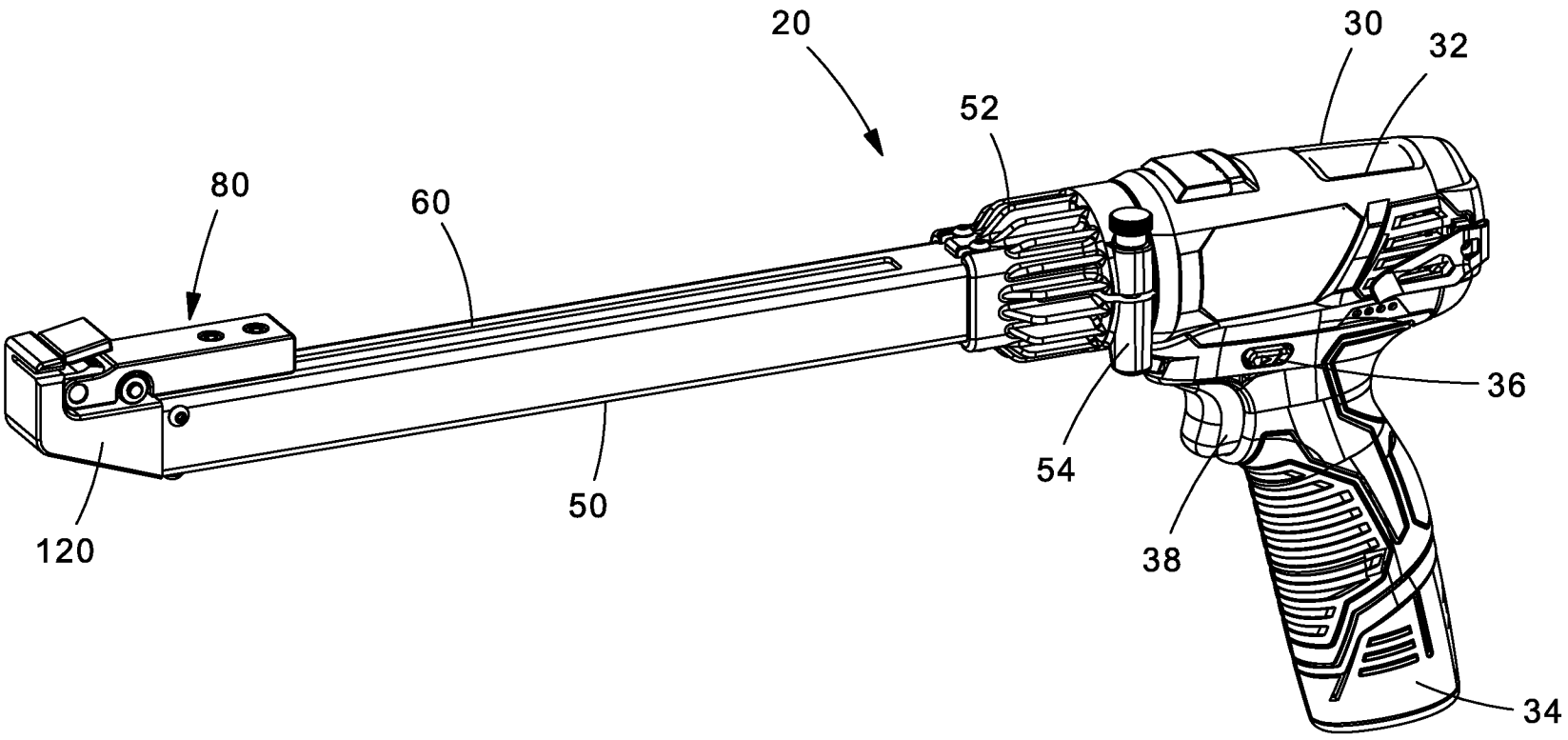
FIG. 1 is a perspective view of the tool of the present invention for tensioning metal locking ties.
Figure 2:
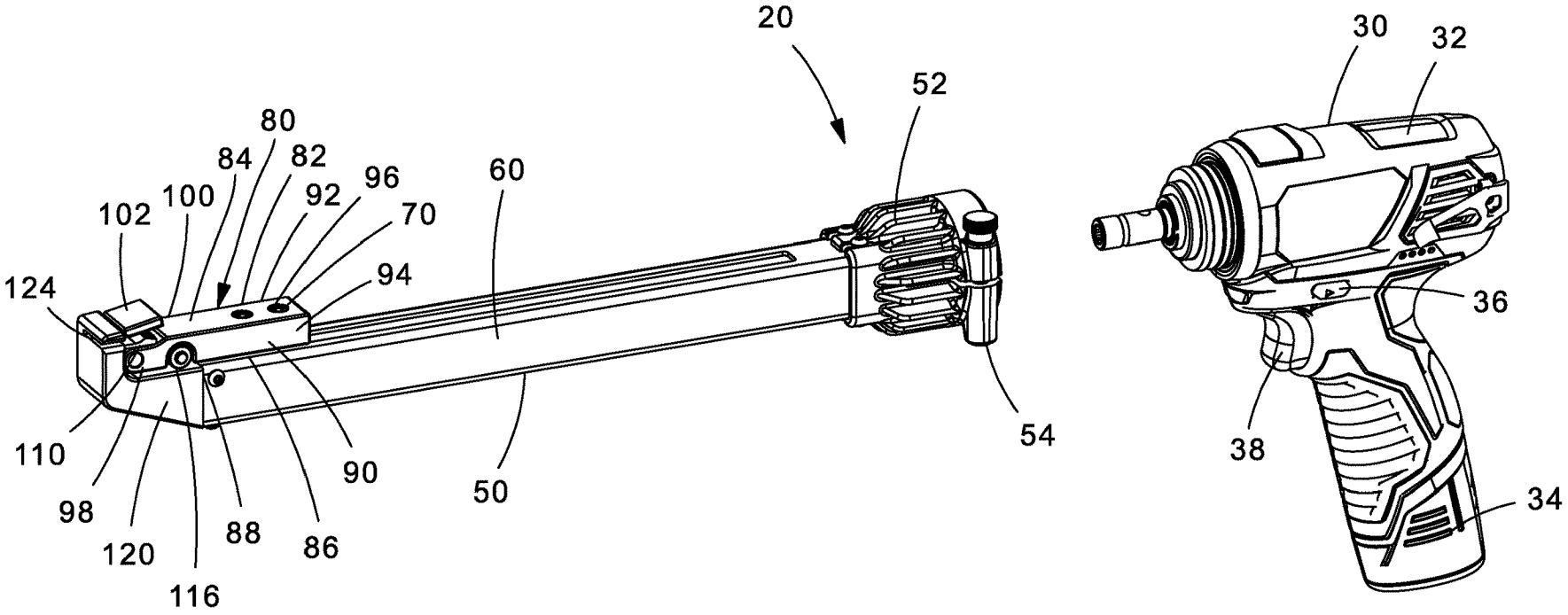
FIG. 2 is a side perspective view of the tool of FIG. 1 with the tool head removed from the tool base.
Figure 3:
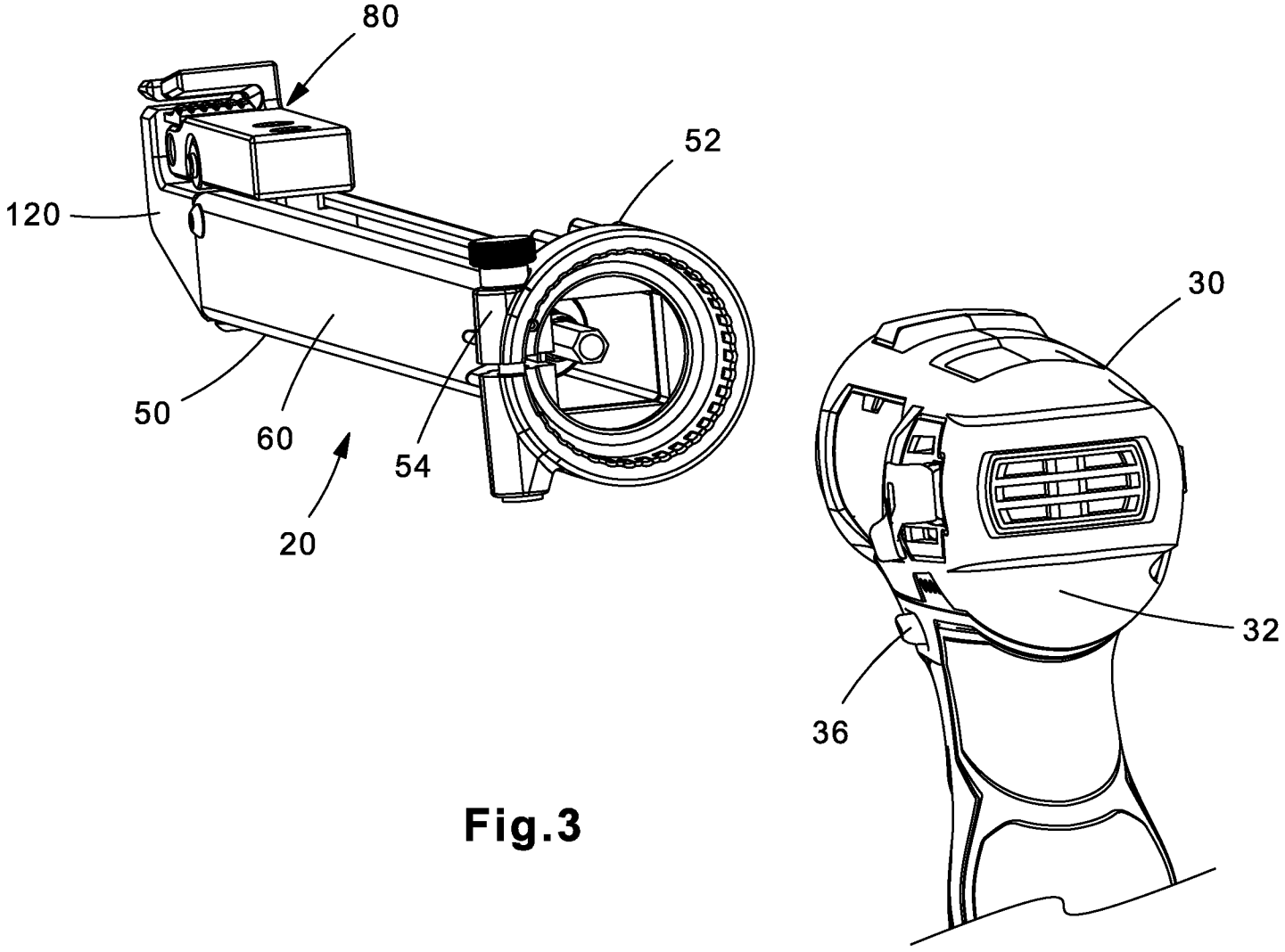
FIG. 3 is a rear perspective view of the tool of FIG. 2.
Figure 4:
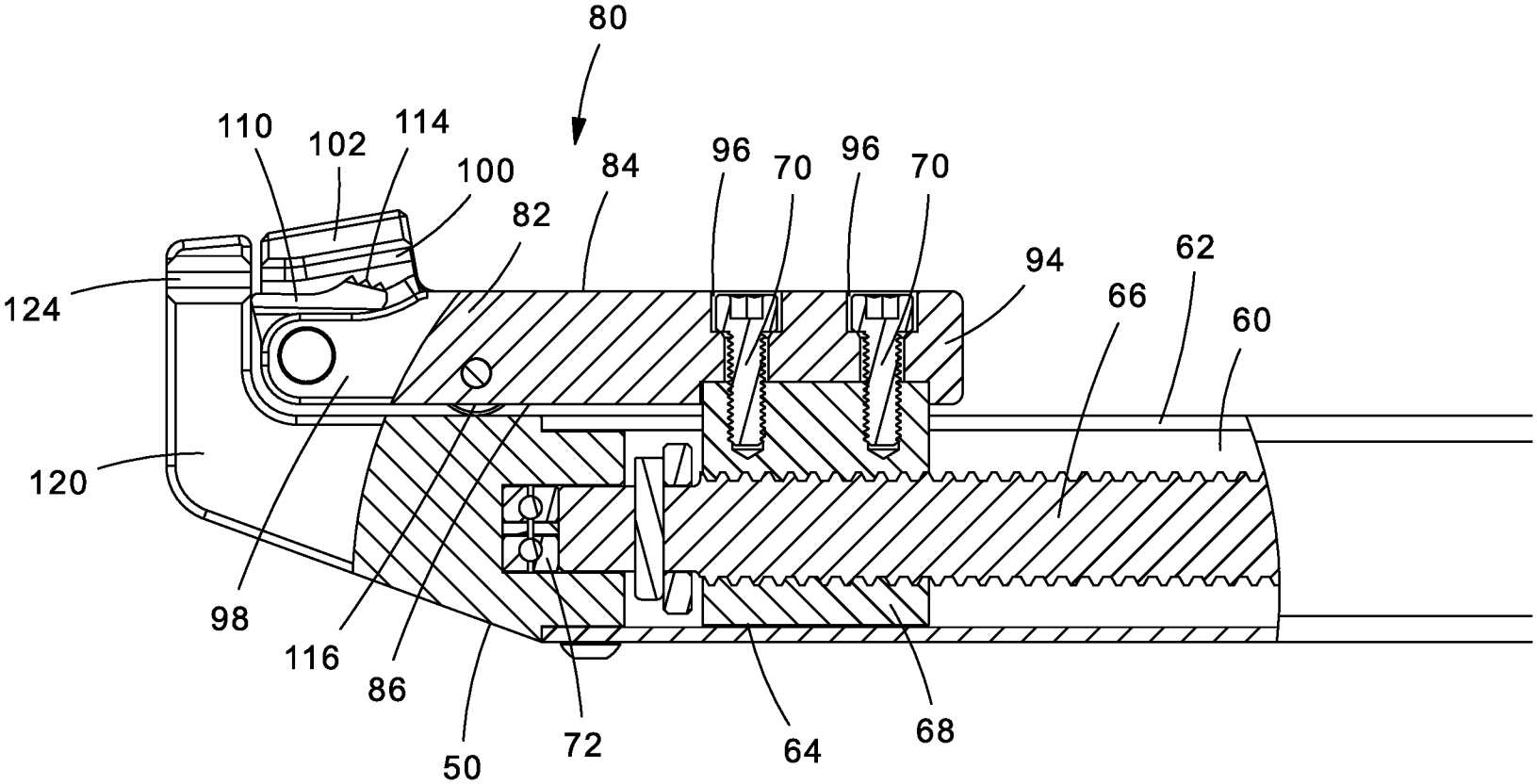
FIG. 4 is partial side sectional view of the tool head of FIG. 2.
Figure 5:
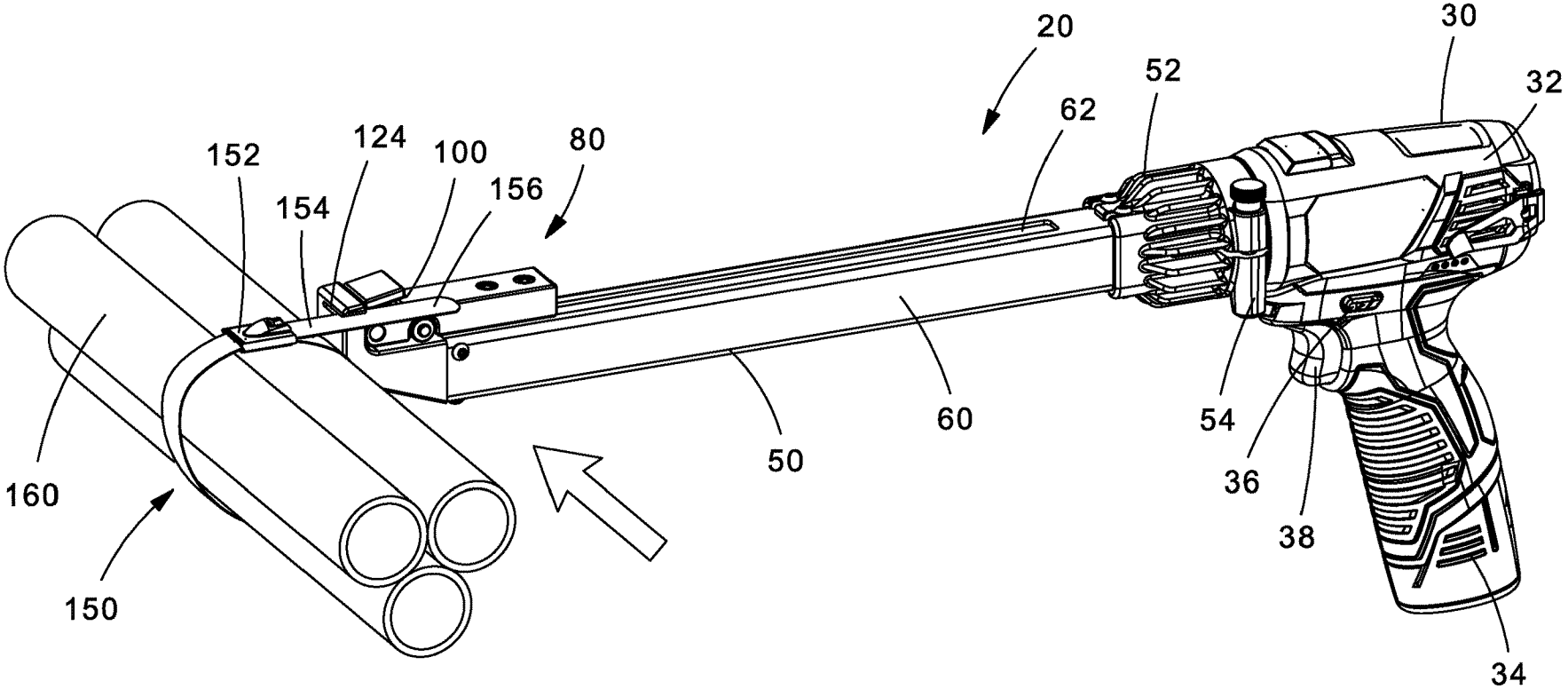
FIG. 5 is a perspective view of the tool of FIG. 1 positioned to receive a metal locking tie wrapped around a bundle.
Figure 6:
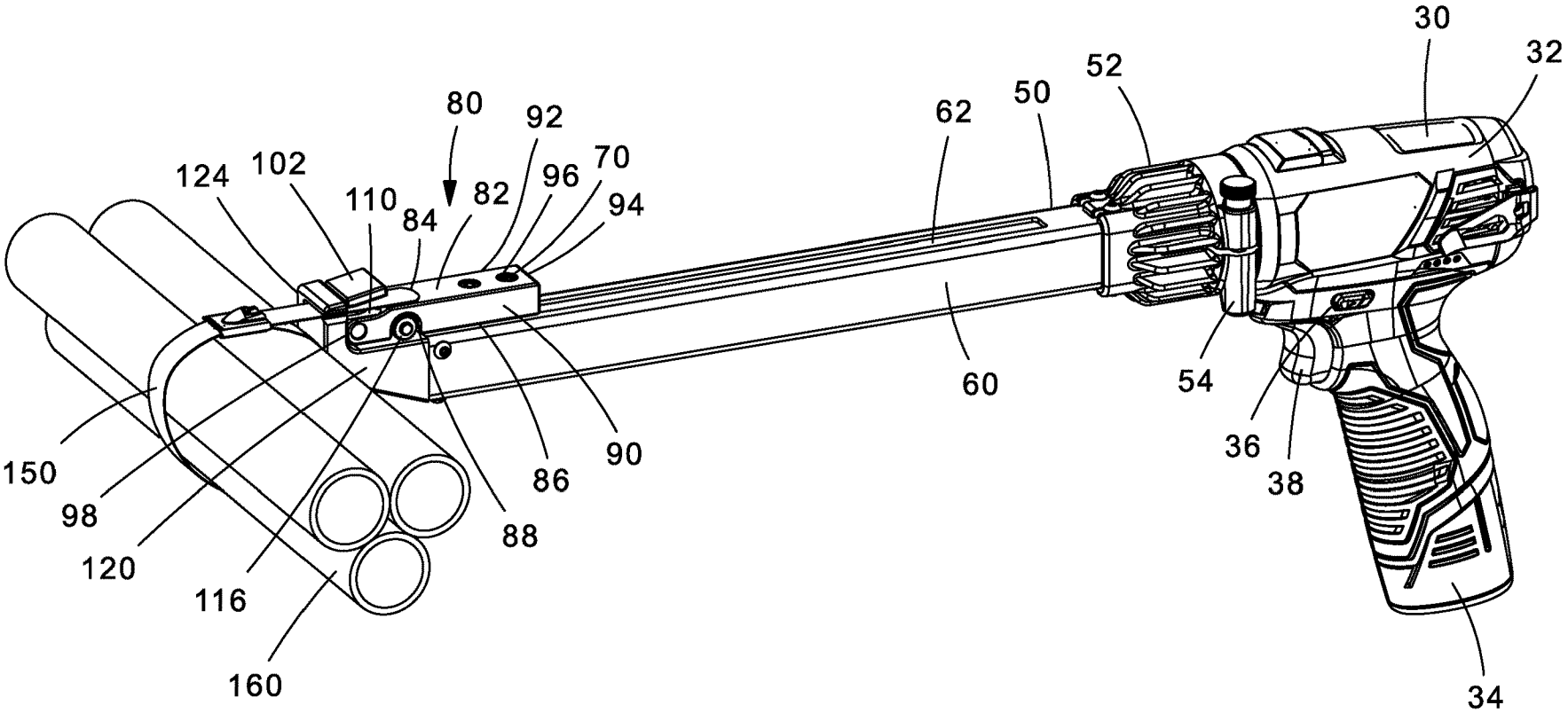
FIG. 6 is a perspective view of the tool of FIG. 5 with the metal locking tie received in the tool nose.
Figure 7:
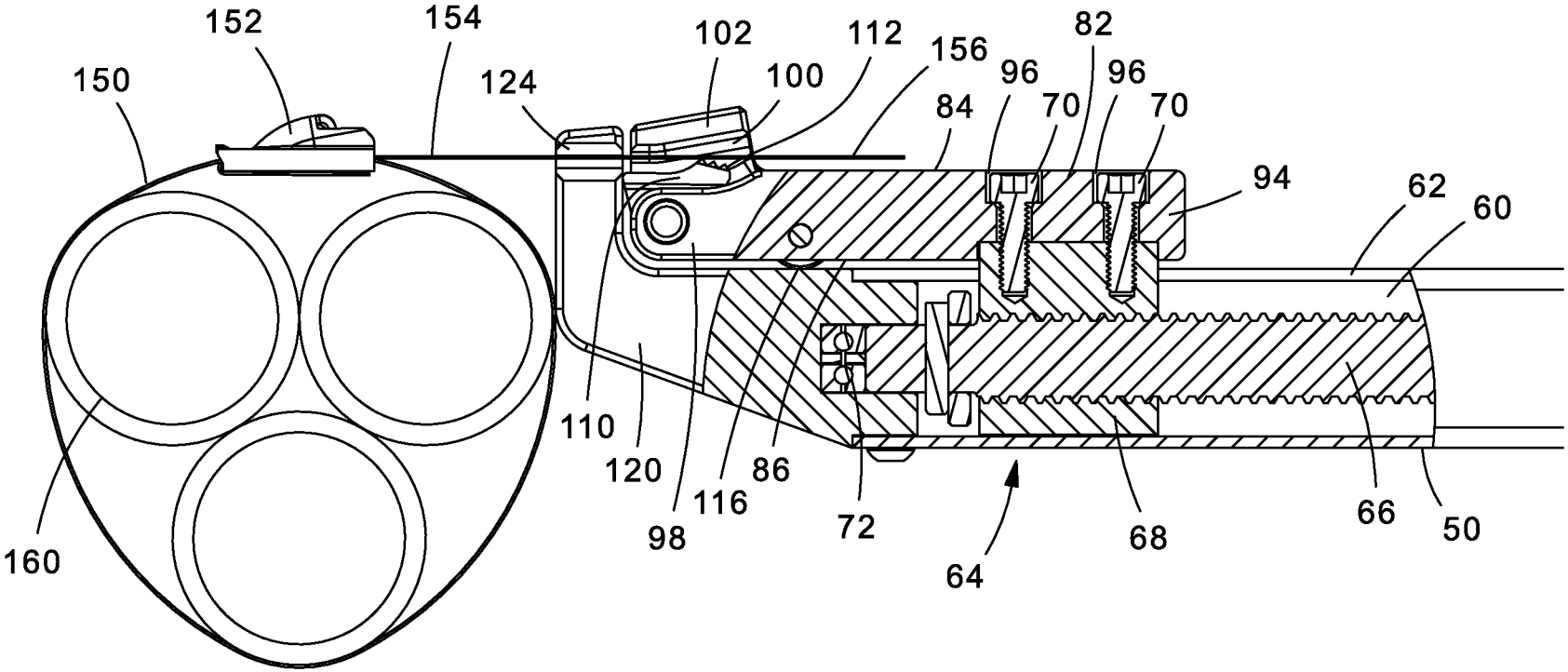
FIG. 7 is partial sectional view of the tool of FIG. 6 with the metal locking tie received in the tool nose.
Figure 8:
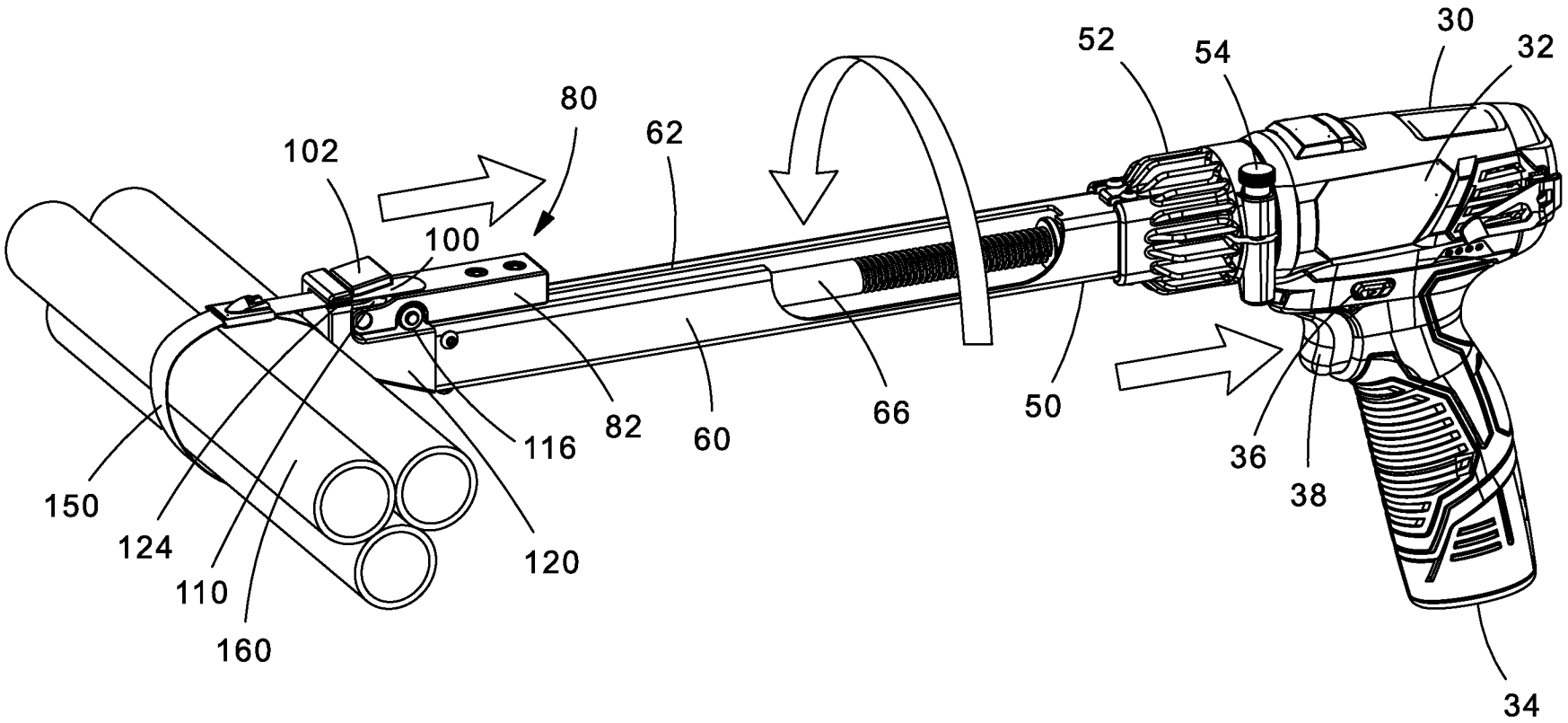
FIG. 8 is a perspective view of the tool of FIG. 6 as the tie is being tensioned.
Figure 9:
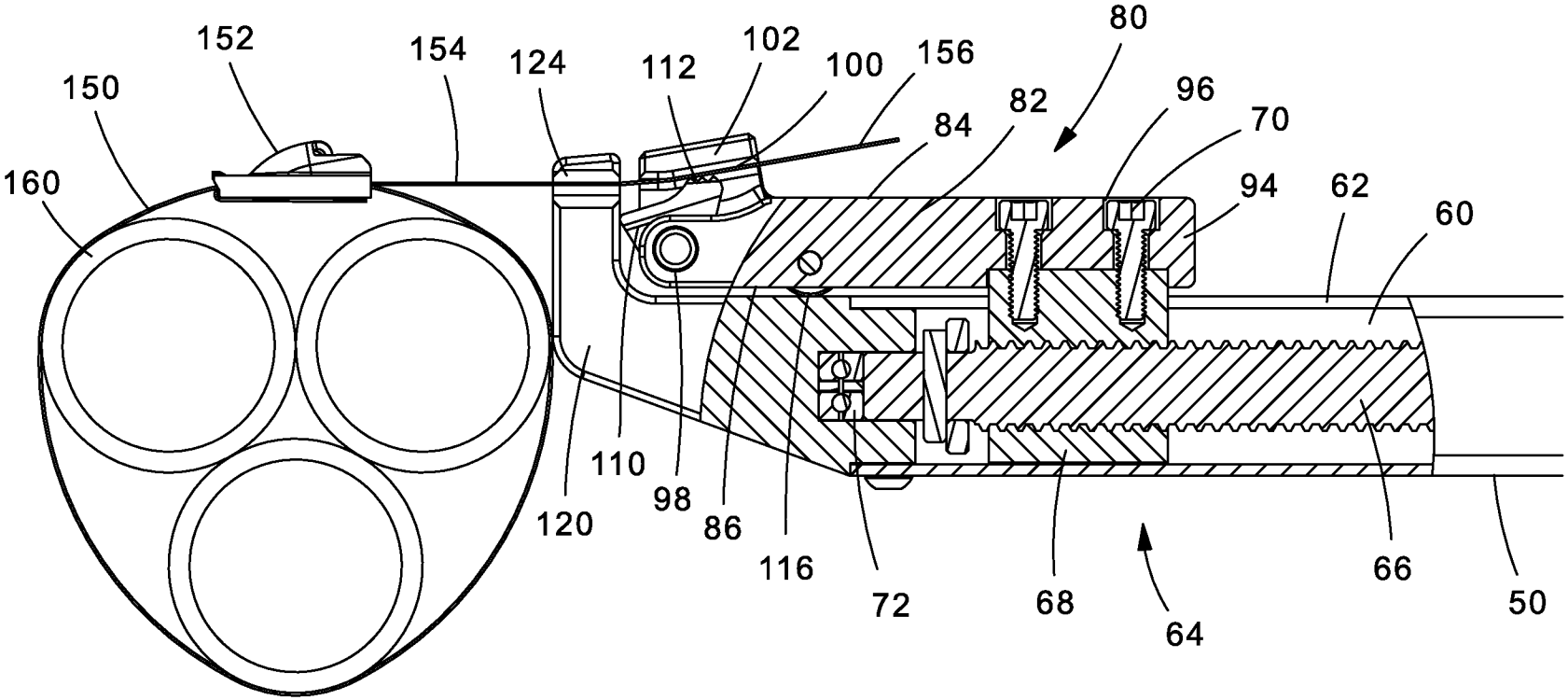
FIG. 9 is a partial sectional view of the tool of FIG. 7 with the gripper engaging the metal locking tie as the tie is beginning to be tensioned.
Figure 10:
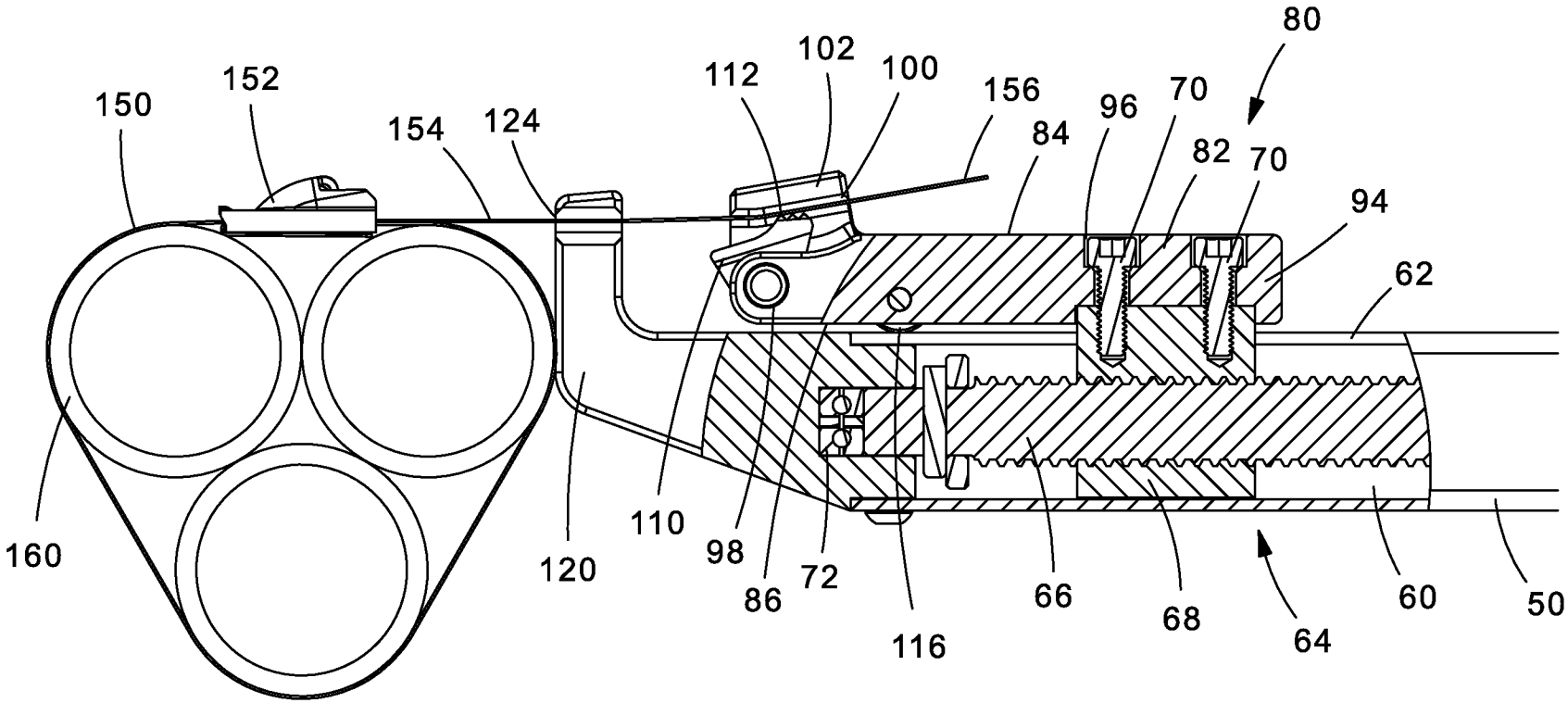
FIG. 10 is a partial sectional view of the tool of FIG. 9 with the gripper engaging the metal locking tie as the tie is tensioned around the bundle.
Figure 11:
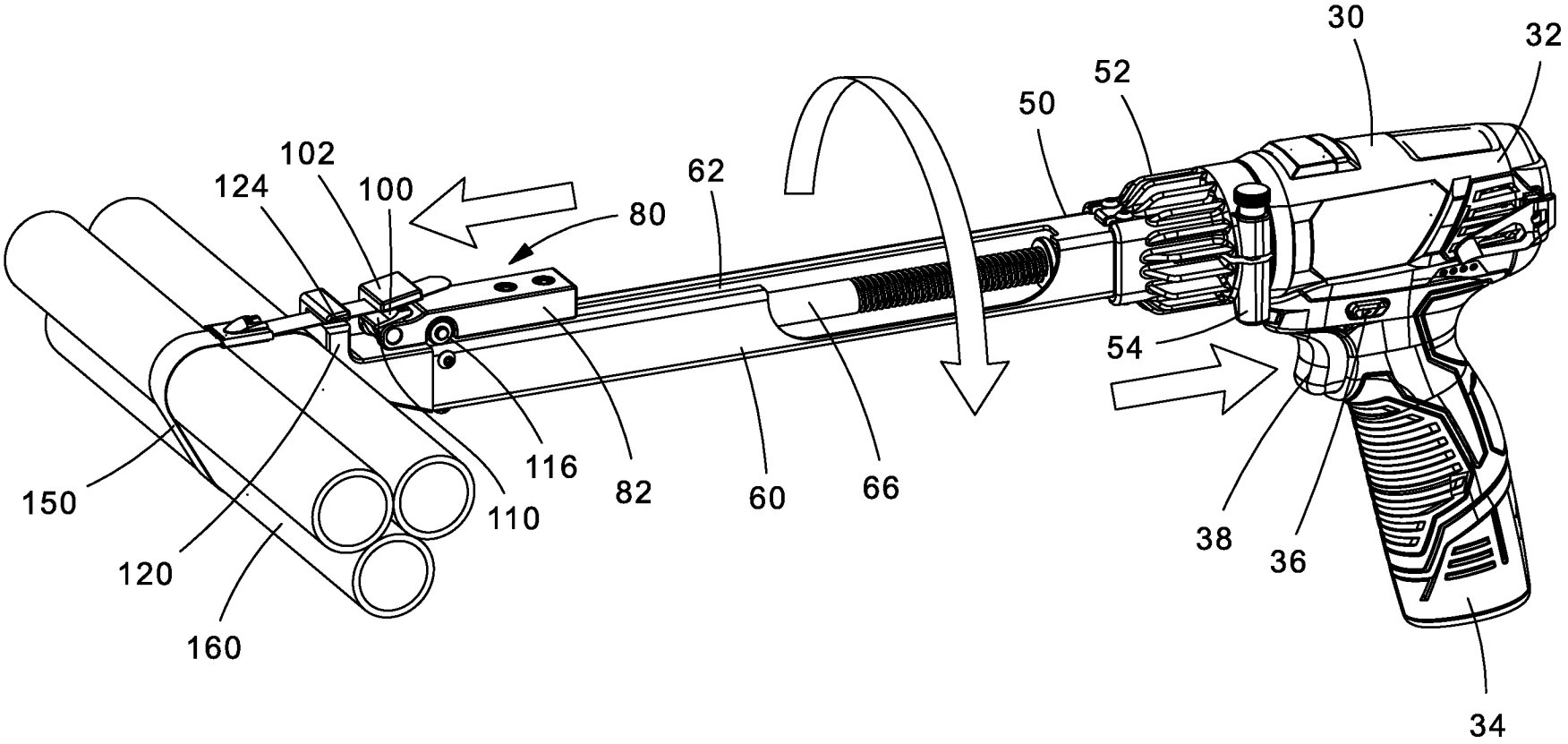
FIG. 11 is a perspective view of the tool of FIG. 10 as the tie is being tensioned.
Figure 12:
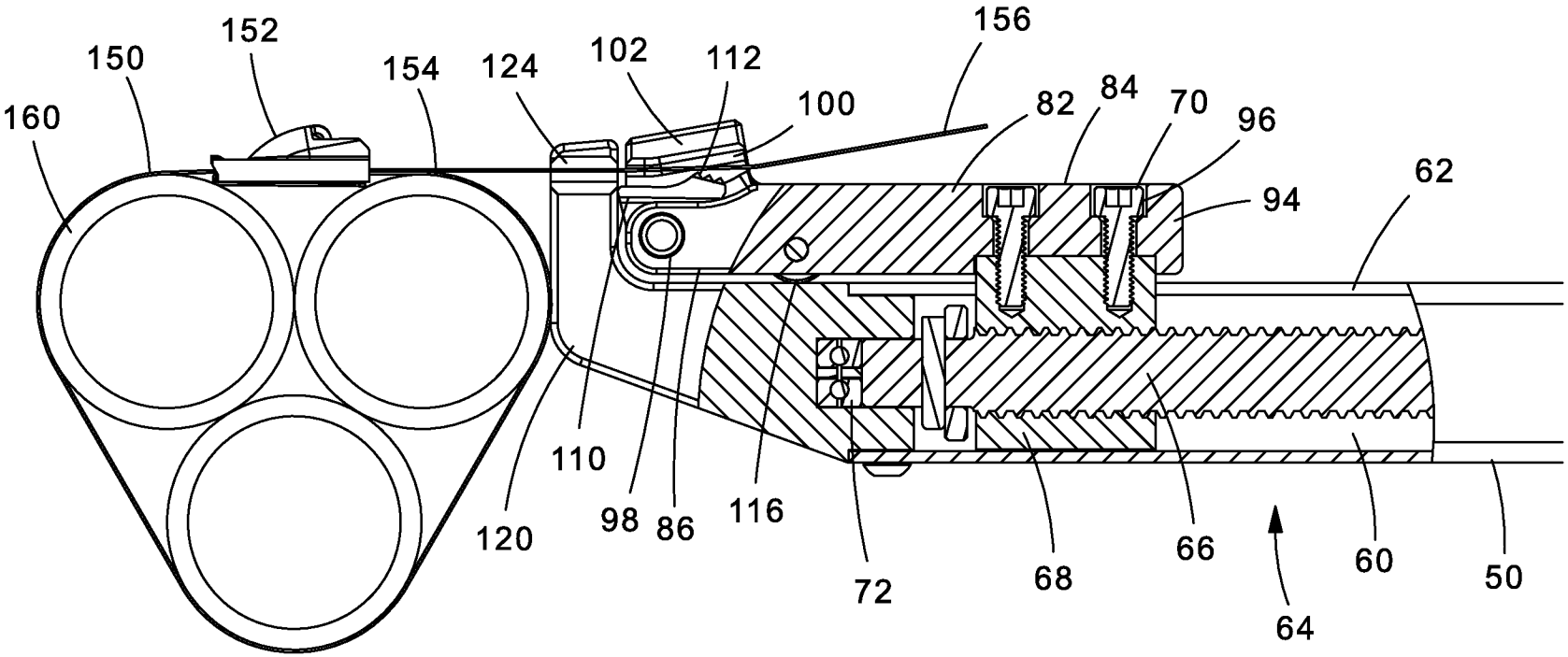
FIG. 12 is a sectional view of the tool of FIG. 6 after the tie has been tensioned.
Figure 13:
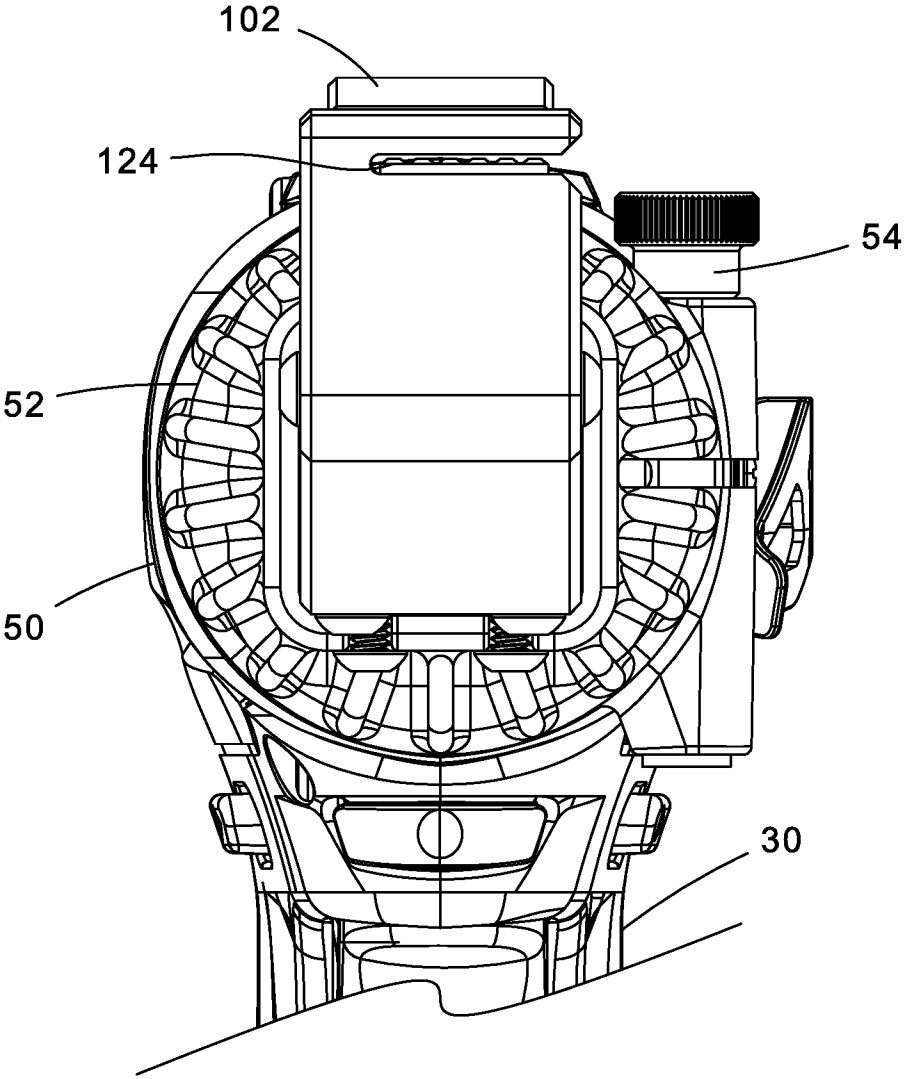
FIG. 13 is a front view of the tool of FIG. 1.

FIG. 1 illustrates a perspective view of the electric tool 20 for tensioning metal locking ties of the present invention. FIGS. 2 and 3 illustrate the electric tool 20 with the tool head 50 detached from the tool base 30. The tool base 30 includes an electric driver 32, a driver battery 34, a selection device 36, and a trigger 38. The tool head 50 is designed to be mounted to the tool base 30 and secured thereto by driver mount 52 and attachment fastener 54.

As illustrated in FIGS. 1-4, the tool head 50 includes a tubular frame 60, a gripper assembly 80, and a tool nose 120. The tubular frame 60 is designed to provide a long reach thereby enabling the tool 20 to tension cable ties 150 in congested tight spaces. The tubular frame 60 is 14 inches long, however, varying lengths of the tubular frame 60 are contemplated. The tubular frame 60 includes a rectangular slot 62 extending along the length of the tubular frame 60. The tubular frame 60 houses the tension mechanism 64 of the tool. The tension mechanism 64 includes a lead screw 66 and a lead nut 68 attached thereto. The lead nut 68 is positioned in the center of the tubular frame 60 and extends through the rectangular slot 62 (see FIG. 4). The tubular frame 60 also includes a lead screw thrust bearing 72 to permit rotation and to support the axial load. The lead screw 66 is attached to the electric driver 32. As discussed below, as the lead screw 66 rotates, the lead nut 68 moves along the lead screw 66.

The tool nose 120 includes a side entry cable tie receiving slot 124. As discussed below, the tie 150 is slid in the side entry cable tie receiving slot 124 to enable the tool to grip the tie 150 for tensioning.

The gripper assembly 80 is secured to the lead nut 68 of the tension mechanism 64 by fasteners 70. The gripper assembly 80 includes a gripper housing 82, a gripper 110, and a rolling member 116. The gripper housing 82 includes a top 84, a bottom 86, a first side 90, a second side 92, a first end 94, and an opposite second end 98. The first end 94 includes fastener openings 96 that extend from the top 84 to the bottom 86 of the gripper housing 82. The fastener openings 96 receive the fasteners 70 that secure the lead nut 68 to the gripper housing 82. The bottom 86 of the gripper housing 82 includes a semi-circular opening 88 that extends from the first side 90 to the second side 92. The second end 98 includes a side entry angled slot 100 for receiving the cable tie 150. The side entry slot 124 in the tool nose 120 aligns with the side entry angled slot 100 in the gripper housing 82. The second end 98 of the gripper housing 82 also includes an upper member 102 which forms a cable tie pressure plate when the cable tie 150 is tensioned.

The gripper 110 is pivotally attached to the second end 98 of the gripper housing 82. The gripper 110 includes a plurality of teeth 114 for engaging the cable tie 150 inserted in the tool 20. The rolling member 116 is positioned under the semicircular opening 88 formed in the bottom 86 of the gripper housing 82. The rolling member 116 facilitates the movement of the gripper housing 82 towards the tool base 30 when the tensioning mechanism 64 is activated.

FIGS. 5-13 illustrate the operation of the tool 20. A metal locking tie 150 is wrapped around a cable bundle 160 and the tip 156 of the strap 154 of the metal locking tie 150 is feed through the tie head 152. The metal locking tie 150 is pre-tensioned by hand until the strap 154 is snug.

The tool 20 of the present invention is prepared for tensioning by returning the gripper housing 82 to a forward home position. When the gripper housing 82 is located in the forward home position, the gripper 110 is pivoted to an open position away from the upper member 102 of the gripper housing 82. The opened gripper 110 enables the tie tip 156 to be easily inserted in aligned side entry slot 124 in the tool nose 120 and the side entry slot 100 in the gripper housing 82.

After the tie tip 156 has been inserted, the tool 20 is pushed against the tie head 152 to minimize the amount of stroked required to reach the predetermined desired tension.

Once the cable tie and tool are in the correct position, the driver selection device 36 is moved to the tensioning position. Next the drive trigger 38 is actuated which causes the drive motor in the tool base 30 to turn the internal lead screw 66 in the tool head 50. As the internal lead screw 66 is turned, the lead nut 68 and attached gripper housing 82 move toward the tool base 30.

When the gripper housing 82 starts to move, the gripper 110 pivots to a closed position towards the upper member 102 of the gripper housing 82. As the gripper 110 closes, it pinches the tie 150 positioned between the gripper 110 and the upper member 102 of the gripper housing 82. The teeth 114 extending from the gripper 110 bite into the tie 150. As the lead screw 66 and lead nut 68 are advanced, the gripped tie 150 is pulled and tightened around a bundle 160.

The tool operator activates the tool until the cable tie has reached the predetermined tension. Once the desired tightness has been reached, the tool operator releases the drive trigger 38. Next, the driver selection device 36 is switched and the gripper housing 82 returns to a forward home position away from tool base 30. Once the gripper housing 82 returns to the forward home position, the gripper 110 pivots open and the operator may easily pull the tool 20 away from the tensioned cable tie 150.

The power tool of the present invention provides fast gripper actuation which improves the quickness of the tool. The power tool enables cable tie tensioning without damaging and distorting the cable tie tip. The side entry of the tie results in an easier tool to operate. The power tool provides a long actuation stroke allowing full tensioning of most ties without running multiple cycles thereby reducing operator fatigue when activating the tool. The power tool also provides the operator the ability to tension to a low tension which allows the cable tie to be released and reused.

Furthermore, while the particular preferred embodiments of the present invention have been shown and described, it will be obvious to those skilled in the art that changes and modifications may be made without departing from the teaching of the invention. The matter set forth in the foregoing description and accompanying drawings is offered by way of illustration only and not as limitation.

The invention claimed is:

1. A tool for tensioning metal locking ties, the tool comprising:

a base including a drive mechanism;

a tool head mounted to the base, the tool head having a tension mechanism, a gripper assembly secured to the tension mechanism, and a tool nose;

wherein the tension mechanism includes a lead screw and a lead nut attached to the lead screw;

wherein the gripper assembly includes a gripper housing and the lead nut is secured to the gripper housing;

wherein the gripper housing further comprising a bottom with a semicircular opening that extends from a first side to a second side of the gripper housing; wherein a rolling member is positioned under the semicircular opening for facilitating movement of the gripper housing.

2. The tool of claim 1, wherein the tool head further comprising a tubular frame with a slot extending a length of the tubular frame; wherein the tubular frame houses the tension mechanism with the lead nut positioned within a center of the tubular frame, the lead nut extends through and above the slot.

3. The tool of claim 2, wherein the tubular frame further comprising a lead screw thrust bearing for permitting rotation of the lead screw.

4. The tool of claim 2, wherein the tubular frame provides the tool with a long reach thereby enabling the metal locking tie to be tensioned in congested spaces.

5. The tool of claim 1, wherein the lead screw is secured to an electric driver in the base, wherein as the lead screw rotates, the lead nut moves along the lead screw pulling the gripper housing toward the base of the tool.

6. The tool of claim 1, wherein the lead nut is secured to a bottom of the gripper housing by fasteners.

7. The tool of claim 1, wherein the tool nose further comprising a side entry alignment slot for receiving the metal locking tie; and the gripper assembly further comprising a side entry alignment slot for receiving the metal locking tie; wherein the side entry alignment slot of the tool nose is aligned with the side entry alignment slot of the gripper assembly.

8. The tool of claim 7, wherein the gripper assembly further comprising a gripper pivotally connected to the gripper housing for engaging the metal locking tie positioned within the side entry alignment slot of the gripper assembly and an upper member forming a pressure plate when the metal locking tie is tensioned.

9. A method of operating a tool for tensioning a metal locking tie, the method comprising:

providing a tool with a base and a tool head mounted to the base, the base having a drive mechanism and the tool head having a tension mechanism and a gripper assembly secured to the tension mechanism, wherein the tension mechanism includes a lead screw and a lead nut attached to the lead screw, wherein the gripper assembly includes a gripper housing and the lead nut is secured to the gripper housing, wherein the gripper housing further comprising a bottom with a semicircular opening that extends from a first side to a second side of the gripper housing, wherein a rolling member is positioned under the semicircular opening for facilitating movement of the gripper housing;

inserting the metal locking tie in a side alignment slot of the tool head;

gripping the metal locking tie to be tensioned; and actuating the drive mechanism to activate the tension mechanism to rotate the lead screw in the tool head.

10. The method of claim 9, wherein activating the tension mechanism includes rotating the lead screw and pulling the attached lead nut and gripper housing toward the tool base.

11. The method of claim 10, wherein the step of gripping the metal locking tie includes pivoting a gripper to a closed position and pinching the metal locking tie between the gripper and an upper member of the gripper housing.

12. The method of claim 11, further comprising the step of advancing the lead screw and attached lead nut until the gripped tie is pulled and tightened around a bundle.

* * * * *